United States Patent [19]

Banzoli et al.

[11] 4,195,426

[45] Apr. 1, 1980

[54] EXTRACTING ORES FROM THE SEA BOTTOM

[75] Inventors: Valeriano Banzoli, Mestre; Vincenzo Di Tella; Paolo Vielmo, both of Padua, all of Italy

[73] Assignee: Tecnomare, S.P.A., Venice, Italy

[21] Appl. No.: 892,197

[22] Filed: Mar. 31, 1978

[30] Foreign Application Priority Data

Apr. 1, 1977 [IT] Italy ..... 84119 A/77

[51] Int. Cl.[2] ..... E02F 7/00

[52] U.S. Cl. ..... 37/60; 37/DIG. 8

[58] Field of Search ..... 37/69, DIG. 8, 60; 299/8, 9

[56] References Cited

U.S. PATENT DOCUMENTS

| | | | |
|---|---|---|---|
| 3,588,174 | 6/1971 | Rossfelder et al. | 299/8 |
| 3,672,725 | 6/1972 | Johnson | 37/DIG. 8 |
| 3,675,348 | 7/1972 | Dane, Jr. | 37/69 |
| 4,010,560 | 3/1977 | Diggs | 37/DIG. 8 |
| 4,030,216 | 6/1977 | Williams | 37/DIG. 8 |
| 4,035,022 | 7/1977 | Hahlbrock et al. | 37/DIG. 8 |

*Primary Examiner*—Clifford D. Crowder

*Attorney, Agent, or Firm*—Morgan, Finnegan, Pine, Foley & Lee

[57] ABSTRACT

In a self-propelled, remotely controlled vehicle adapted to operate on the sea bottom for extracting ores therefrom, a V-shaped tubular structure has at its apexes a system of crawlers for moving the structure on the sea bottom. Underneath each side of the V-shaped structure, a scraping system is operative and its long axis is perpendicular to the corresponding side of the V-shaped structure. Tubular conveying systems for elevating the ore to the surface are provided. The V-shaped structure is collapsible by means of hydraulic actuators.

3 Claims, 2 Drawing Figures

EXTRACTING ORES FROM THE SEA BOTTOM

This invention relates to a tracked vehicle for subsea use which is controlled from a remote position and is adapted to work in deep waters (down to 6,000 meters of water depth) for the extraction and the preliminary treatment of ores which can be found on the sea bottom. The vehicle is particularly adapted to the extraction and preliminary treatment of poly-metallic modules scattered at depths on the bottom surface or the superficial layers thereof. Many systems are already known for performing ore-extraction operations, but these are impaired by a number of limitations both from the point of view of their operability and their efficiency. These systems can be of the passive or of the active type.

The passive structures are equipped with appropriate scraping members which are dragged on the sea bottom by a control barge. These installations are electrically controlled from the surface and operate in a discontinuous manner by carrying out from time to time the exploitation of restricted areas of the sea bottom. In both cases, systems having an extremely reduced efficiency are involved, both for the impossibility of checking the areas scanned by the system and as regards the quantity of material extracted relative to that which is available.

The extraction system which is the subject-matter of the present invention operates in a continuous manner and, by continuously displacing the collecting tool on the sea bottom, works upon a stripe having an appropriate width.

The system permits in a regular manner the exploitation of subsea ore deposits and avoids, by virtue of its system of locomotion and guiding, the repeated working of the same area or leaving unexploited areas. The power required for the system is generated on the surface on a control barge and is transferred to the system by a connection cord which is composed of the electric cables which are necessary both to transfer power and to transfer from and to the control barge all the signals both of the measuring and the control type, which are required for control.

Passing now to the detailed description of the subsea extraction system, reference will be had to the accompanying drawings which illustrate a practical embodiment of the system, given by way of example only without limitation, many modifications and changes being possible without departing from the scope of the invention. In the drawings.

Figure 1:
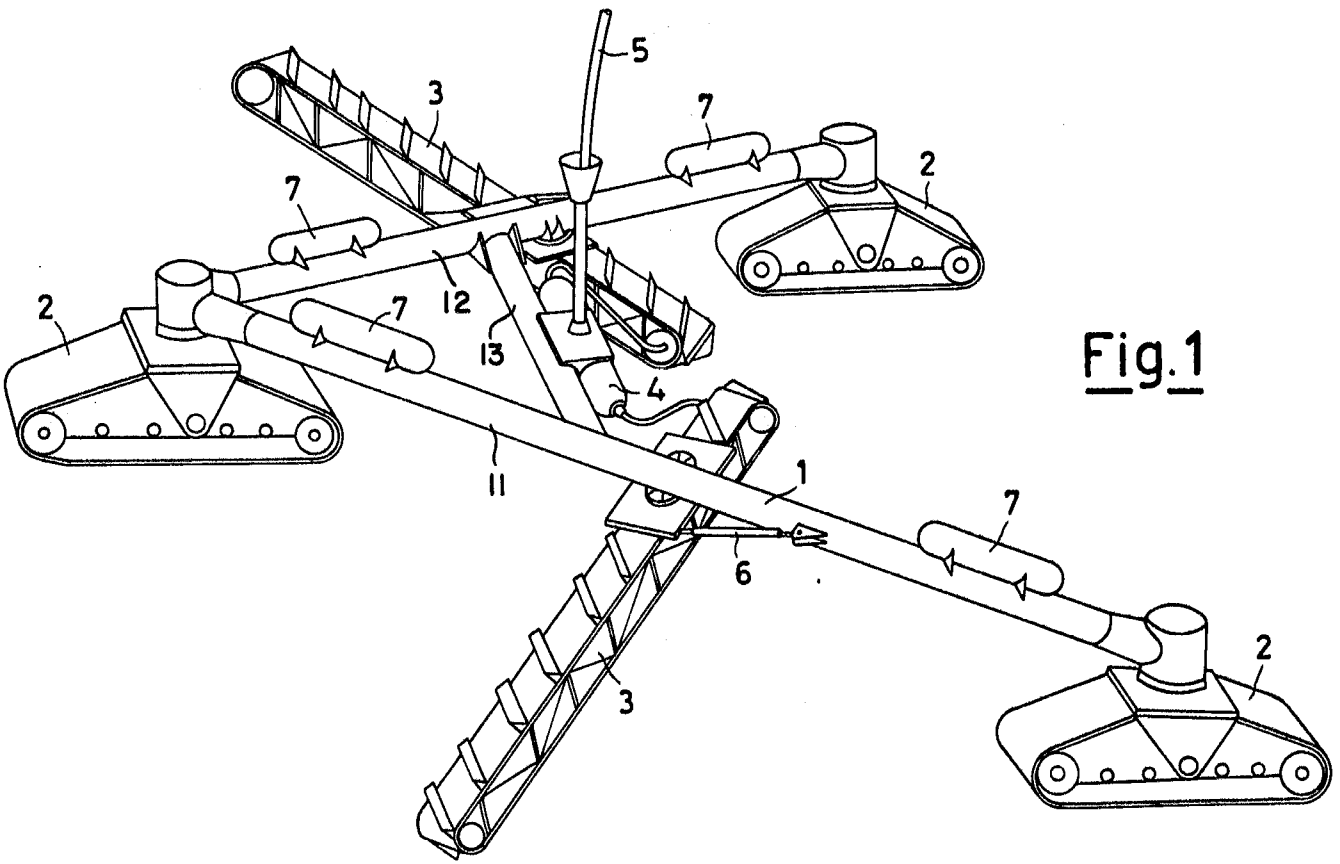
FIG. 1 is an overall perspective view of the vehicle of the invention.
Figure 2:
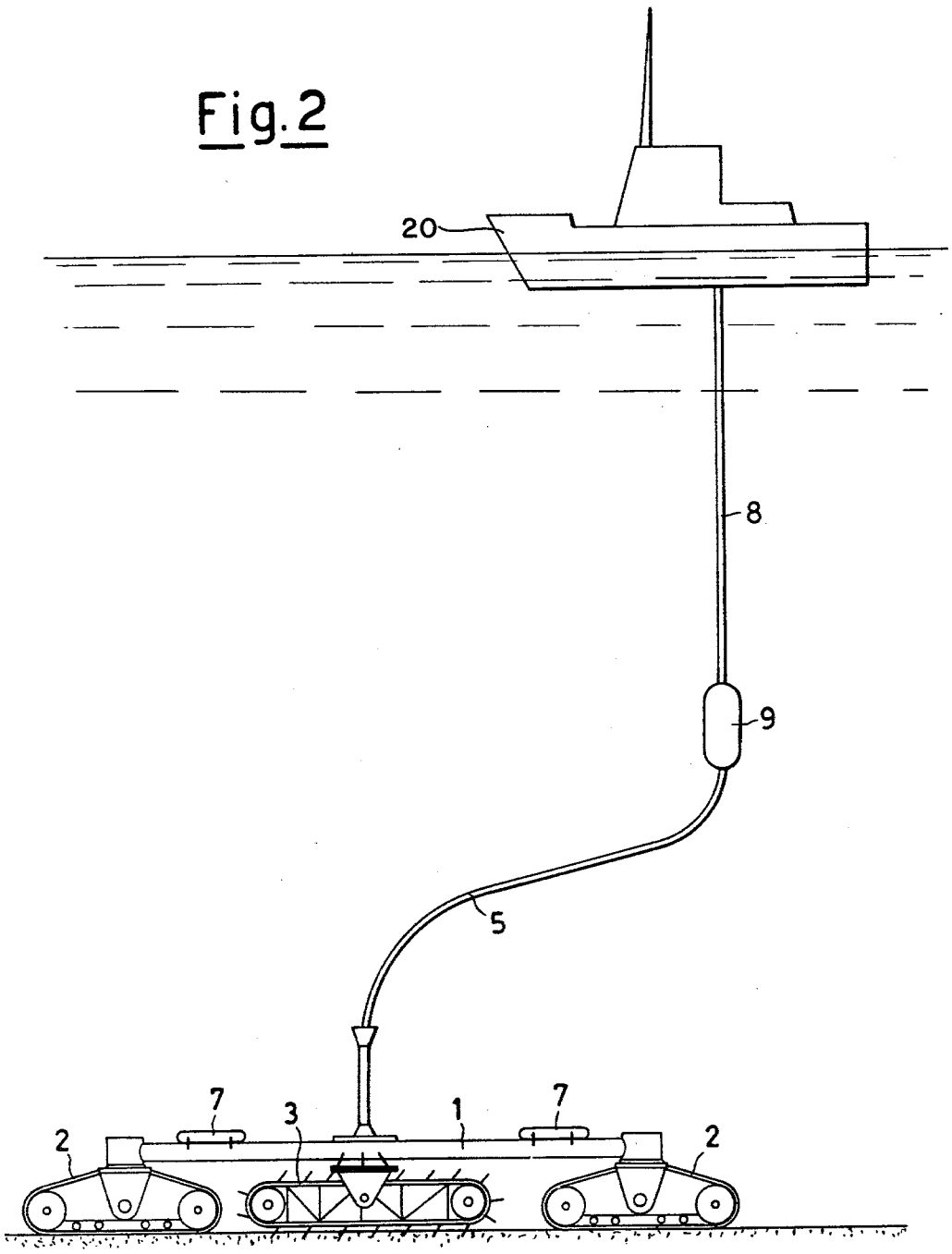
FIG. 2 shows a diagram illustrative of the practical use of the vehicle.

The extraction system is essentially composed of a tubular structure 1 having the form of a "V" with two long tubular legs 11 and 12 and a shorter crosspiece 13. The structure 1 is equipped for being moved on the sea bottom, with three self-propelled tracks 2 or wheel systems arranged at its apexes. The extraction of the ore is performed by two chains of baskets 3, which, scraping the sea bottom, extract the solid ores and convey them to a screening and triturating station 4. The lifting of the ore from unit 4 takes place through hose 5 according to conventional methods, such as compressed air or pumps. The material is conveyed by the unit 9 which contains the conveyance devices (pumps and the like) and to which the hose 5 is coupled at its upper end to the barge 20 through the vertical duct 8.

The chains of baskets are located at approximately the midpoint of legs 11 and 12 and are supported by structures which are suspended under the vehicle and are inclined with respect to the direction of motion of the vehicle so as to travel, during motion, over paths which are transverse relative to the direction of the motion. Since the two extraction tools 3 operate in opposite directions, there is no transfer of considerable stresses to the vehicle tending to deflect the vehicle from its intended path. Rather with an appropriate ratio of the speed of travel of the scrapers 3, to the forward speed of the vehicle, a scraper 3 moving across a submarine bed will travel along a line perpendicular to the intended direction of movement of the vehicle thus directing the extracted ore towards the unit 4.

During the operation of transportation and submersion of the tools or basket chains 3 for the ore extraction, the units 3 can be collapsed by specially provided hydraulic jacks 6, so as to facilitate these operations.

The vehicle is fed with electric power from the surface through a feeding cord which is connected to the hoses 5 and 8 which are used for lifting the ore 5 to the surface. In the cylindrical hulls 7 are housed the majority of the electric, hydraulic and control apparatus.

The vehicle has a control system which enables it to be guided accurately over preselected paths. The variation of the vehicle weight while maintaining the vehicle on the sea bottom takes place by a ballast system which is based on the displacement, either partial or total, with sea water, of a fluid which is lighter than sea water, by transferring the latter to a tank carried by the member 13.

By this system both the structures and the containers for the apparatus are compensated as to pressure equilibrium.

We claim:

1. A self-propelled vehicle for the extracting of ores from the sea bottom adapted to operate in deep waters comprising:

a substantially "A" shaped tubular structure, having a pair of legs joined at an apex and a cross-member joining said legs at an intermediate point, a self-propelled crawler mounted to the tubular structure at the apex thereof and at the base of each leg, said crawlers each including integrally mounted drive means and an endless belt driven thereby to propel the vehicle along the sea bottom, excavating means, perpendicularly mounted at substantially the mid-point of each leg and each including a basket chain arrangement operating in an opposite direction for minimizing stresses, for collecting ores and feeding said ores to a predetermined location intermediate the legs, a screening and pretreatment unit mounted to the cross member intermediate the legs for receiving the ores from the excavating means, and, tubular conveying means for elevating the ore to the sea surface, said means being mounted to the pretreatment unit.

2. A vehicle in accordance with claim 1 further including:

pumping means coupled to the tubular conveying means to force the ore to the sea surface, and, a ballast system comprising a tank mounted to the cross member, a fluid lighter that sea water contained therein and means for displacing said fluid with sea water.

3. A vehicle in accordance with claim 2 further including:

cylindrical hulls mounted on the tubular legs having control means mounted therein responsive to signals from above the sea surface to drive the vehicle in a predetermined direction, and, hydraulic means mounted to the legs at one end and to an excavating means at the other end to maintain said excavating means perpendicular to the legs during operation and be capable of collapsing said excavating means during installation.

* * * * *